United States Patent [19]

Bonazoli et al.

[11] 3,959,688

[45] May 25, 1976

[54] CONTROL CIRCUIT FOR XENON FLASH TUBES

[75] Inventors: Robert P. Bonazoli, Hamilton; Ellison H. Kirkhuff, Needham, both of Mass.

[73] Assignee: GTE Sylvania Incorporated, Danvers, Mass.

[22] Filed: Jan. 3, 1975

[21] Appl. No.: 538,439

[52] U.S. Cl. ..... 315/240; 315/241 R; 315/245

[51] Int. Cl.[2] ..... H05B 41/14

[58] Field of Search ..... 315/240, 241 R, 238, 315/245, 200 A

[56] References Cited

UNITED STATES PATENTS

| | | | |
|---|---|---|---|
| 3,334,270 | 8/1967 | Nuckolls | 315/240 X |
| 3,725,734 | 4/1973 | Schneider | 315/240 X |
| 3,792,309 | 2/1974 | McDonald | 315/245 X |

FOREIGN PATENTS OR APPLICATIONS

| | | | |
|---|---|---|---|
| 1,204,065 | 10/1965 | Germany | 315/240 |

*Primary Examiner*—R. V. Rolinec
*Assistant Examiner*—Darwin R. Hostetter
*Attorney, Agent, or Firm*—James H. Grover

[57] ABSTRACT

A circuit for switching storage capacitors in a high voltage xenon flash tube circuit includes at least one storage capacitor with parallel low and high resistance paths in series with the capacitor, switching means selecting one of the two paths and a time delay device triggering discharge of the tube at a predetermined interval, the discharge time constant of said one capacitor being a substantial portion of the triggering interval. The time delay device enables operation of the switching means a substantial time after triggering discharge.

5 Claims, 2 Drawing Figures

CONTROL CIRCUIT FOR XENON FLASH TUBES

BACKGROUND OF THE INVENTION

Xenon flash tubes and like high voltage discharge devices are used in aviation approach lighting systems, obstruction beacons and other high energy systems where it is desirable to vary the intensity of the light flash from high intensity in day time to lower intensity at night. A xenon flash tube intensity can be varied by changing the applied voltage but only over a narrow range with a maximum intensity 5 times the minimum intensity, whereas a range of 100 to 1 is needed to suit day, night and intermediate conditions.

Flash intensity control systems are known which switch capacitors of different energy storage capacities into the discharge circuit. Contact switches burn out or fuse and fail very quickly because the switching inevitably occurs at times during the discharge of one capacitor. At such times there will be very high current surging through the contacts between charged and partially or wholly discharged capacitors. High current vacuum tube relays can carry the surge currents but are very expensive and involve considerable additional circuitry.

It is the object of the present invention to provide a simple, low cost high voltage capacitor switching system, which avoids surges through the switching means and which permits control over a wide range, for example of 100 to 1 intensities.

STATEMENT OF INVENTION

According to the invention a circuit for controlling the light intensity of a high voltage discharge tube over a wide range of intensities comprises a high voltage supply, a plurality of storage capacitors connected in parallel across said supply, a discharge device connected in parallel with the capacitors, timing means for triggering discharge of the device at a predetermined interval, at least one of the storage capacitors having in series therewith a low resistance discharge path and a high resistance path in parallel, and switch means to select one of the paths, the high resistance path and said one storage capacitor having a time constant equal to a substantial part of the predetermined interval, so that until the low resistance path is selected by the switch means said one storage capacitor is not substantially discharged relatively to the high voltage supply.

DRAWINGS

Figure 1:
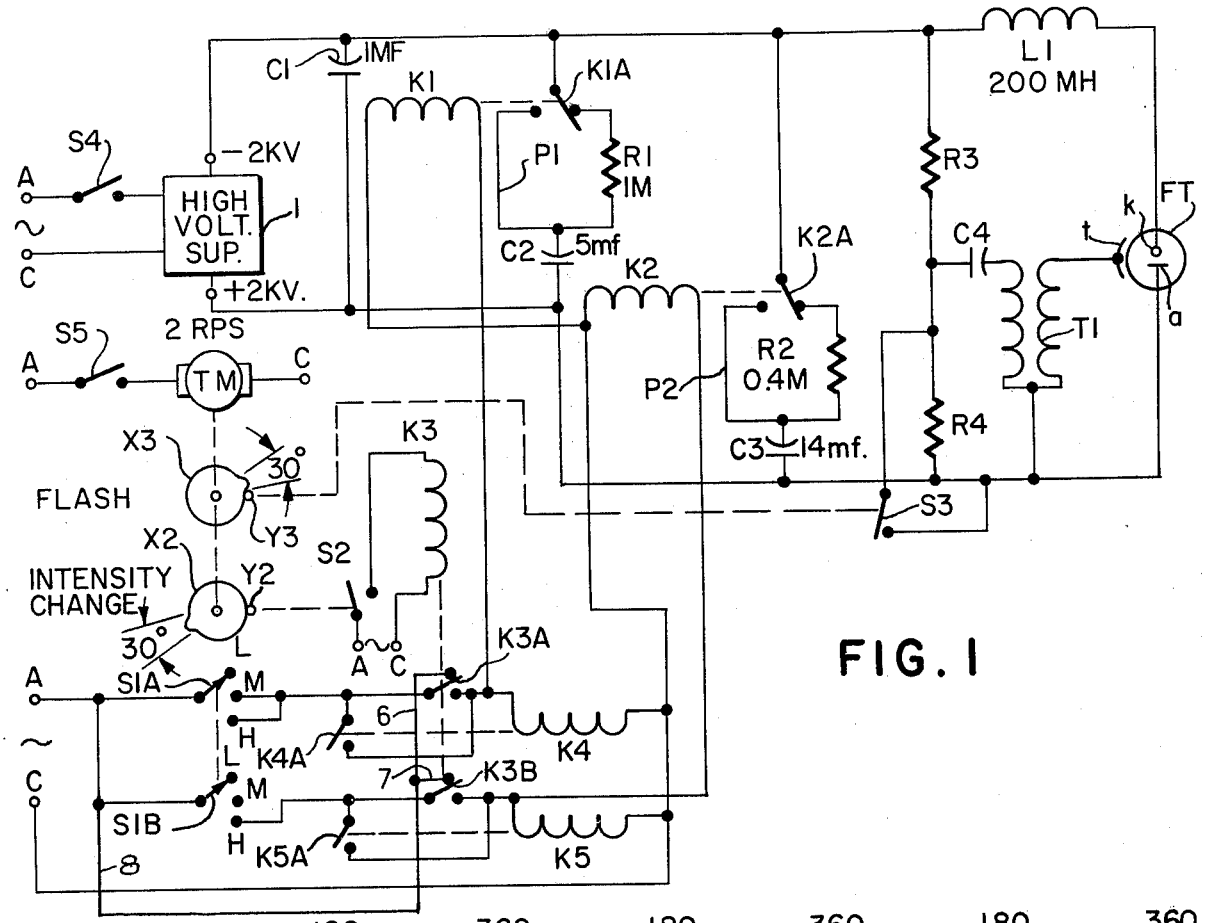
Figure 2:
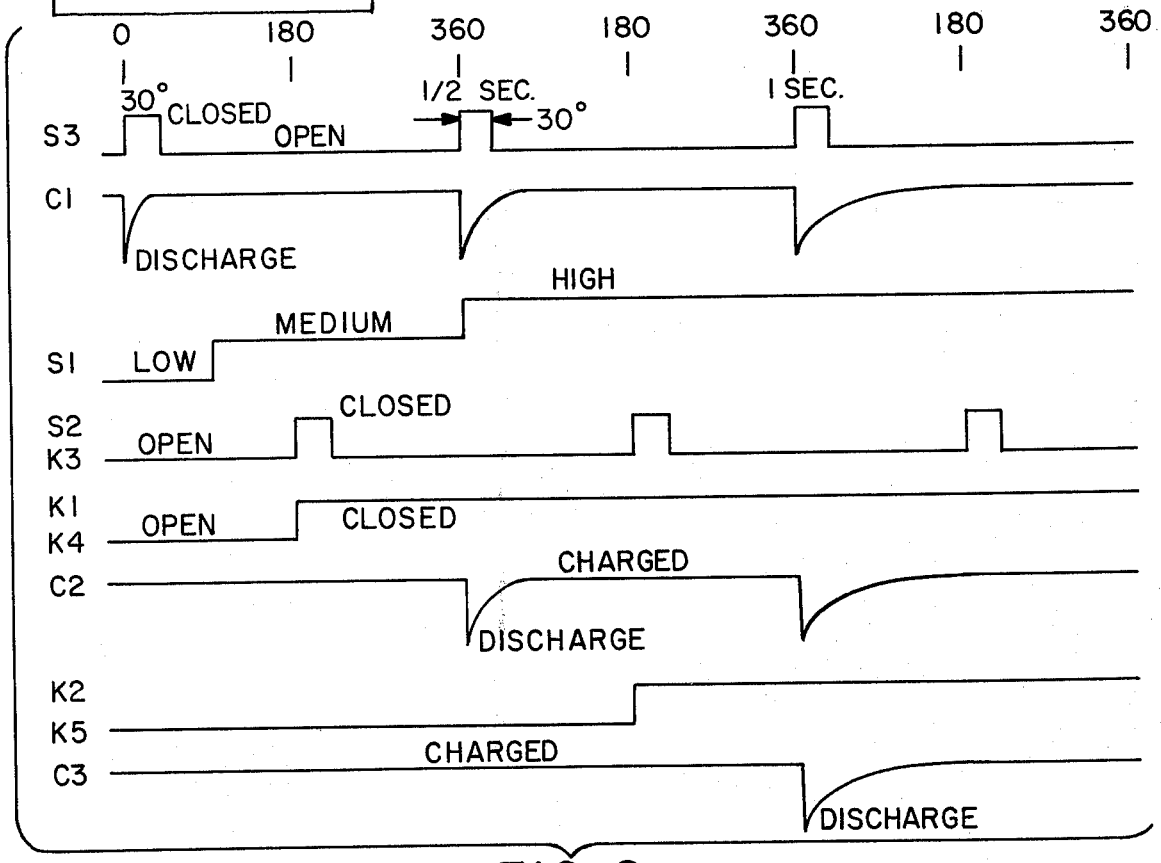

FIG. 1 is a schematic diagram of a xenon flash tube control circuit according to the invention; and FIG. 2 is a graph showing the relative times of operation of the circuit components in FIG. 1.

DESCRIPTION

The circuit of FIG. 1 controls the intensity of discharge of a xenon flash tube FT, Sylvania type R4335 having a cathode *k*, an anode *a* and a trigger winding *t*. With a power switch S4 closing connection to alternating current terminals A and C to a high voltage supply 1, the supply 1 provides a 2000 volts charge for three storage capacitors C1, C2 and C3 having capacities of 1, 5 and 14 microfarads respectively. As explained more fully hereafter one or more of the capacitors discharge through a choke L1 and the flash tube FT when a trigger pulse is applied to the trigger winding *t* causing ionization and firing of the tube. Resistors R3 (1.4 megohms) and R4 (160 kilohms) divide the supply voltage to about 125 volts at their junction, charging a trigger capacitor C4 (0.2 microfarads) to this voltage. When a cam X3 driven by a timing motor TM actuates its cam follower and closes a trigger switch S3, the trigger capacitor C4 discharges through the primary of a pulse transformer T1 which steps up the voltage to 5000 to 8000 volts at the trigger winding *t* as required to trigger the flash tube FT and initiate its discharge and light emission at an intensity related to storage capacity and watt-second power of one or more of the storage capacitors C1, C2 and C3.

As suggested above, the intensity of flash tube emission may be varied over a wide range by switching storage capacitors C2 and C3 into the discharge circuit. For example, if storage capacitor C2 were to discharge in parallel with capacitor C1 and 5 microfarad capacity of C2 added to the 1 microfarad capacity of C1 would increase the light intensity from about 1 to 26 percent of maximum. If then the 14 microfarad capacity of C3 were added the intensity would be increased to 100 percent.

If capacitor C2 were simply switched in parallel with capacitor C1, as by transferring relay contact K1A to a low resistance path P1 at a random time, the charges on capacitors C1 and C2 may be unequal. Very high current of several thousand amperes would surge from the charged to the relatively discharged capacitor through the contact K1A. Such surges will occur frequently enough to cause the inevitable and early failure by welding or other destruction of the contacts which the present invention avoids in one or more of the following three ways. First, the additional capacitors are maintained at full charge except at the time of flash tube ignition. Second, capacitor switching is delayed until after the brief charge-discharge interval of any capacitor. Third, the triggering and switching intervals are timed so as not to overlap.

Each of the additional capacitors C2 and C3 are maintained at full charge during charge and discharge of storage capacitor C1 by connection in a relatively high resistance path including resistor R1 in series with capacitor C2, and resistor R2 in series with capacitor C3. The time constant of each of the two RC series circuits is approximately 5 seconds, which is too long for appreciable discharge of either capacitor C2 or C3 during the relatively short (500 microsecond maximum) discharge interval of the flash tube, but which allows these two capacitors to become fully charged from the supply 1, until they are switched into the flash tube discharge circuit. Thus prior to being added in the discharge circuit the two additional storage capacitors C2 and C3 are held at very nearly the same charge as capacitor C1.

With the maintenance of full charge on both of the additional storage capacitors C2 and C3, switching of each or both of them into the flash tube discharge circuit is controlled by the timing motor TM whose cam X3 closes the flash tube trigger switch S3 previously described. A second cam X2 actuating a follower Y2 closed an enabling switch S2 energizing a timing relay K3. The timing relay enabling contacts K3A and K3B respectively complete connections to one or both of two holding relays K4 and K5 and to one or both storage capacitor switch relays K1 and K2. Alternating current power to the switching relays K1 and K2 is supplied from terminals A and C through a three position, manual intensity change switch S1 having two ganged wipers S1A and S1B. The manual switch S1 has three positions:

Low (L) in which neither storage capacitor C2 nor C3 is added to capacitor C1 in the flash tube discharge circuit;

Medium (M) in which relays K4 and K1 are energized, transferring contact K1A from the high resistance path of resistor R1 to the parallel low resistance path of conductor P1 to capacitor C2. With this connection capacitor C2 can discharge in parallel with capacitor C1 with the medium flash tube intensity previously described;

High (H) in which the medium intensity relays K4, K1 and relays K5 and K2 are energized, additionally transferring contact K2A from the high resistance path of resistor R2 to the parallel low resistance path of conductor P2 to capacitor C3, which thereafter can discharge in parallel with capacitors C1 and C2 with high flash tube intensity.

In FIG. 1 the cams X2 and X3 are shown with cam actuators of about 30° angular extent, the actuators of cams X2 and X3 being disposed 180° apart. Typically the timing motor TM driving the cams turns at 2 RPS so that the flash tube trigger follower Y3 and switch S3 are actuated once each half second, and the enabling relay K3 and its contacts K3A and K3B are transferred one quarter second later.

As shown in FIG. 2 the trigger switch S3 is held closed for a 30° interval.

Also as shown in FIG. 2 energization of enabling relays K3 and K4 and K1, which switch in additional capacitor C2, is delayed 180°, one-quarter second after flash tube triggering, to insure that capacitor C1 is fully recharged before capacitor C2 is switched in to the flash tube discharge circuit. A second purpose of this 180° delay is to insure that switching of capacitor C2 or C3 into the flash tube discharge circuit does not occur during discharge through the flash tube. Thus, if the manual intensity selector switch S1 is transferred from Low (L) position to Medium (M) position during the first 180° turn of the trigger cam Y3, relay contact K1A can not be closed until the end of the 180° angular displacement between cams X2 and X3. Similarly if the manual selector S1 is switched to High (H) position at the instant of flash tube triggering at 360°, energization of relays K2 and K5 and switching of the remaining additional storage capacitor C3 into the flash tube discharge circuit can occur only well after capacitors C1 and C2 are recharged. Also switching of capacitors C2 and C3 out of the flash tube discharge circuit is delayed until after discharged by connections 6, 7 and 8 from the contacts of relay K3 to line terminal A, which connections hold relays K4 and K5 energized through contacts K4A and K5A respectively until relay K3 contactors K3A and K3B are transferred from the position shown in FIG. 1 by the timing motor.

It is therefore possible with the present invention to switch storage capacitors of substantially different capacities in combinations providing a wide range of 1 to 100 percent, or greater by using additional capacitors. The switching may be done with simple mechanical relays despite the high currents their contacts will carry, because the timing motor insures that the capacitors will be equally charged at the time the contacts are transferred, and that the contacts will already be fully closed or open at the time of flash tube discharge.

It should be understood that the present disclosure is for the purpose of illustration only and that this invention includes all modifications and equivalents which fall within the scope of the appended claims.

We claim:

1. A circuit for controlling the light intensity of a high voltage discharge tube over a wide range of intensities comprising:
   - a high voltage supply,
   - a plurality of storage capacitors connected in parallel across said supply,
   - a discharge device connected in parallel with the capacitors for discharging the capacitors,
   - means for triggering the discharge device,
   - at least one of the storage capacitors having in series therewith a low resistance discharge path and a high resistance path in parallel,
   - and switch means to select one of the paths,
   - the high resistance path and said one storage capacitor having a time constant substantially longer than the discharge time through a low resistance path, so that until the low resistance path is selected by the switch means said one storage capacitor is not substantially discharged relatively to the high voltage supply.

2. A circuit according to claim 1 wherein the triggering means includes timing means to delay selection of a low resistance path by the switch means for a non-overlapping time after triggering of the discharge device.

3. A circuit according to claim 1 wherein the triggering means includes timing means for triggering discharge of the device at a predetermined interval.

4. A circuit according to claim 3 wherein the time constant of the high resistance path and said one capacitor is a substantial part of said predetermined interval.

5. A circuit according to claim 2 wherein the triggering means includes timing means for triggering discharge of the device at a predetermined interval.

* * * * *